United States Patent [19]

Rogo et al.

[11] Patent Number: 4,552,308

[45] Date of Patent: Nov. 12, 1985

[54] TURBINE ENGINE VARIABLE GEOMETRY DEVICE

[75] Inventors: Casimir Rogo, Mt. Clemens; Herman N. Lenz, Lambertville, both of Mich.

[73] Assignee: Teledyne Industries, Inc., Los Angeles, Calif.

[21] Appl. No.: 199,469

[22] Filed: Oct. 22, 1980

[51] Int. Cl.[4] ..... B05B 15/00

[52] U.S. Cl. ..... 239/457; 415/150

[58] Field of Search ..... 239/456, 457, 458; 415/150, 147, 148, 149, 151, 160, 43, 44

[56] References Cited

U.S. PATENT DOCUMENTS

| | | | |
|---|---|---|---|
| 2,739,782 | 3/1956 | White | 253/52 |
| 2,763,426 | 9/1956 | Erwin | 230/114 |
| 3,365,120 | 1/1968 | Jassniker | 230/114 |
| 3,407,740 | 10/1968 | Samerdyke | 103/97 |
| 3,478,391 | 11/1969 | Kunderman | 230/114 |
| 3,489,391 | 1/1970 | Kanger et al. | 415/157 |
| 3,829,237 | 9/1974 | Chestnutt | 415/181 |
| 3,887,295 | 6/1975 | Yu | 415/116 |
| 3,975,911 | 8/1976 | Morgulis et al. | 60/602 |
| 3,994,620 | 11/1976 | Spraker, Jr. et al. | 415/145 |
| 4,003,675 | 1/1977 | Stevens et al. | 415/150 |
| 4,149,826 | 4/1979 | Torstenfelt | 415/127 |

*Primary Examiner*—James B. Marbert
*Assistant Examiner*—Gene A. Church
*Attorney, Agent, or Firm*—Gifford, VanOphem, Sheridan & Sprinkle

[57] ABSTRACT

A variable geometry device for use with the turbine nozzle of a turbine engine of the type having a support housing and a combustion chamber contained within the support housing. A pair of spaced walls in the support housing define an annular and radially extending nozzle passageway. The outer end of the nozzle passageway is open to the combustion chamber while the inner end of the nozzle passageway is open to one or more turbine stages. A plurality of circumferentially spaced nozzle vanes are mounted to one of the spaced walls and protrude across the nozzle passageway. An annular opening is formed around the opposite spaced wall and an annular ring is axially slidably mounted within the opening. A motor is operatively connected to this ring and, upon actuation, axially displaces the ring within the nozzle passageway. In addition, the ring includes a plurality of circumferentially spaced slots which register with the nozzle vanes so that the vane geometry remains the same despite axial displacement of the ring.

10 Claims, 3 Drawing Figures

TURBINE ENGINE VARIABLE GEOMETRY DEVICE

The invention described herein was made in the performance of work under NASA Contract No. NAS 3-22005 and is subject to the provisions of Section 305 of the National Aeronautics and Space Act of 1958 (72 Stat. 435; 42 U.S.C. 2457).

BACKGROUND OF THE INVENTION

I. Field of the Invention

The present invention relates generally to variable geometry devices employed in turbine engines and, more particularly, to such a device for use in the nozzle passageway between the turbine engine combustion chamber and the turbine stage or stages.

II. Description of the Prior Art

A conventional turbine engine includes a support housing, a compressor having an outlet rotatably mounted within the support housing and a diffuser passageway which fluidly connects the compressor outlet to a combustion chamber also contained within the support housing. Following combustion within the combustion chamber, the exhaust gases from the combustion chamber exhaust through a turbine nozzle and thereafter through one or more turbine stages.

In many previously known turbine engines, the nozzle passageway is generally annular in shape having in its outer end open to the combustion chamber so that the gas stream through the nozzle passageway is directed radially inwardly. In addition, many of the previously known turbine engines include nozzle vanes extending across the nozzle passageway to aerodynamically control and shape the flow of the gas stream from the combustion chamber and to the turbine stages.

Many turbine engine applications require that the turbine engine be operated over a broad range of operating conditions. These different operating conditions have different gas stream flow requirements for maximum engine efficiency. Moreover, it is desirable to maintain high turbine engine efficiency at all engine operating conditions in order to minimize surge, cavitation and other engine instabilities while maximizing fuel economy.

One previously known method of broadening the flow capacity characteristics in the nozzle passageway is to use variable geometry engine components. One previously known method of varying the geometry of the turbine nozzle has been to pivot the nozzle vanes to the support housing and then the angle or pitch of the nozzle vanes.

The previously known pivoted nozzle vanes, however, have not proven wholly satisfactory in use. One disadvantage of this method results from the leakage losses from the nozzle passageway and around the pivoted nozzle vanes and into the support housing. These leakage losses are further amplified due to the large openings in the nozzle passageway walls which are required to compensate for thermal distortion and relative thermal expansion between the nozzle walls and the nozzle vanes.

A still further disadvantage of the previously known pivoted nozzle vanes is that it is difficult to accurately pivot all of the nozzle vanes to the same angle due to mechanical backlash and mechanical play. Unwanted and undesired turbulences result when the nozzle vanes are positioned at different angles.

SUMMARY OF THE PRESENT INVENTION

The present invention provides a variable geometry device for use in the nozzle passageway of a turbine engine which overcomes the disadvantages of the previously known variable geometry devices.

In brief, in the present invention two spaced walls in the support housing form an annular nozzle passageway having its outer end open to the combustion chamber and its inner radial end open to one or more turbine stages. A plurality of circumferentially spaced nozzle vanes are secured to one support housing wall and extend transversely or axially across the nozzle passageway. These nozzle vanes aerodynamically shape the gas stream from the combustion chamber and to the turbine stages in the conventional fashion.

An annular opening is formed around the entire circumfery of the other nozzle passageway wall. Thereafter, a ring is axially slidably mounted within this opening so that one axial end of the ring is exposed to the nozzle passageway and axially aligned with the nozzle vane. Moving means are also attached to the other end of the ring for moving the ring between an axially retracted and extended position.

In its retracted position, the exposed end of the ring is spaced from the facing nozzle wall so that the nozzle passageway is unrestricted. Conversely, in its extended position, the ring protrudes into and restricts the nozzle passageway.

In the preferred form of the invention, a plurality of circumferentially spaced slots are formed in the ring so that one slot registers with and slidably receives one nozzle vane therein. Thus, the nozzle vane geometry remains fixed regardless of the position of the ring.

BRIEF DESCRIPTION OF THE DRAWING

A better understanding of the present invention will be had upon reference to the following detailed description when read in conjunction with the accompanying drawing wherein like reference characters refer to like parts throughout the several views, and in which.

DETAILED DESCRIPTION OF A PREFERRED EMBODIMENT OF THE PRESENT INVENTION

Figures 1, 2, 3:
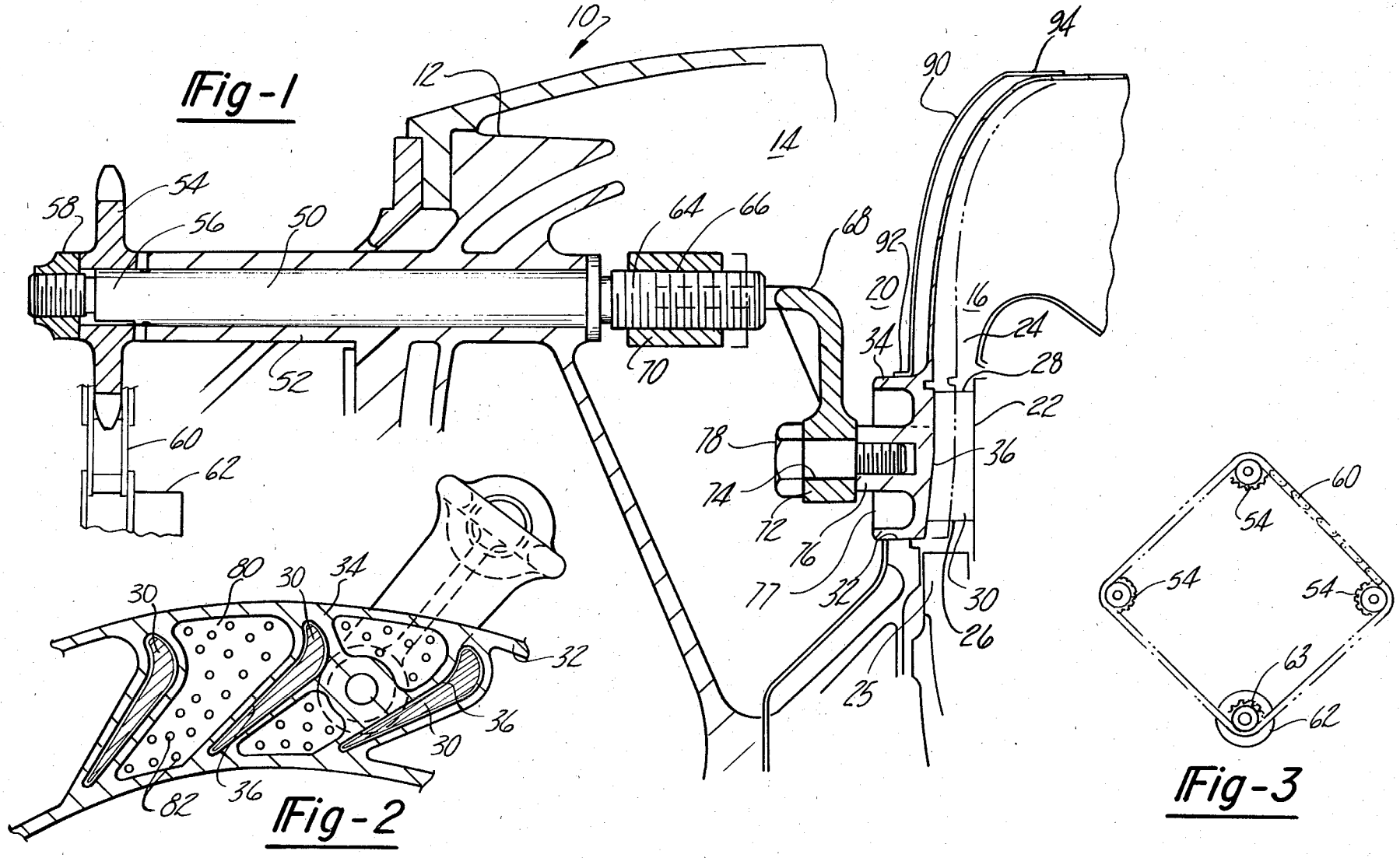
FIG. 1 is a fragmentary sectional view illustrating a portion of the turbine engine utilizing a preferred embodiment of the variable geometry device of the present invention.
FIG. 2 is a fragmentary sectional view of the preferred embodiment of the present invention taken substantially along line 2—2 in FIG. 1 and enlarged for clarity.
FIG. 3 is an axial diagrammatic view of a portion of the preferred embodiment of the present invention.

With reference first to FIG. 1, a portion of a turbine engine 10 is thereshown and comprises a support housing 12 in which a combustion chamber 14 is contained. The combustion chamber 14 includes an outlet 16 through which the combustion products or gas stream from the combustion chamber 14 exhaust.

The support housing 12 includes a first annular nozzle wall 20 and a second annular nozzle wall 22 which, together, form an annular nozzle passageway 24 within the support housing 12. The inner radial end 26 of the nozzle passageway 24 is open to the inlet for one or more turbine stages 25 while the outer radial end 28 of the nozzle passageway 24 is open to the outlet 16 from the combustion chamber 14. Thus, in the well known fashion, the nozzle passageway 24 fluidly connects the combustion chamber outlet 16 with the turbine stages 25 of the turbine engine 10.

With reference still to FIG. 1, a plurality of circumferentially spaced nozzle vanes 30 (only one illustrated) are fixedly secured to the nozzle wall 20 and extend entirely transversely across the nozzle passageway 24. These nozzle vanes 30 are of a fixed geometry and aerodynamically shape the gas stream from the combustion chamber 14 and to the turbine stages 25. The nozzle vanes 30 also extend along an axis parallel to the axis of rotation of the turbine stages 25.

Referring now to FIGS. 1 and 2, an annular opening 32 is formed around the entire circumfery of the other nozzle wall 22. A ring 34 having a front face 36 is then axially slidably positioned within the opening 32 so that the ring 34 also extends entirely around the nozzle passageway 24 and so that the front face 36 of the ring 34 is exposed to the nozzle passageway 24. The ring 34 is rigid in construction and is preferably formed by casting. The ring 34 also has a plurality of circumferentially spaced slots 36 (FIG. 2) formed through it so that each slot 36 registers with and slidably receives one nozzle vane 30 therein.

With reference now to FIGS. 1 and 3, a plurality of circumferentially spaced actuating rods 50 are rotatably mounted in tubular sleeves 52 formed in the support housing. The actuating rods 50 are substantially parallel to the rotational axis of the turbines 25 and are circumferentially spaced from each other within the support housing 12 as is best seen in FIG. 3.

A sprocket 54 is attached to one end 56 of each rod 50 by a retainer 58 so that each sprocket 54 rotates in unison with its rod 50. In addition, a chain 60 (FIG. 3) is drivingly connected around all of the sprockets 54 while suitable motor means 62 (FIG. 3) is drivingly connected with chain 60. The motor means 62 can be of any conventional construction, such as a hydraulic or electric motor. Upon actuation of the motor 62, all of the sprockets 54 with their attached actuating rods 50 are rotatably driven in the same rotational direction and by the same rotational amount.

The other axial end 64 of each actuating rod 50 is externally threaded at 66. An L-shaped actuating member 68 having an internally threadable boss 70 at one end is threaded to the externally end 64 of each actuating rod 50. The opposite end 72 of each actuating member 68 includes a bore 74 formed through it on an axis parallel to the axis of the rod 50. This bore 74 in turn registers with an internally threaded boss 76 on the rear face 77 of the ring 34. A bolt 78 then extends through the bore 74 in each actuating member 68 and threadably engages the registering boss 76 on the ring 34 to rigidly secure the actuating members 68 to the ring 34. This attachment between the actuating members 68 and ring 34 also holds the actuating members 68 against rotation relative to the actuating rods 50.

With reference now particularly to FIG. 1, because of the threaded connection between the actuating rods 50 and actuating member 68, rotation of the actuating rods 50 by the motor 62 axially displaces the ring 34 between a retracted position, illustrated in solid line, and an extended position, illustrated in phantom line. The nozzle passageway 24 is more restricted when the ring is in its extended position than its retracted position and vice versa. Moreover, as the ring 34 is moved between its retracted and extended positions, the nozzle vanes 30 are slidably received within the slots 36 on the ring 34. Consequently, the axial displacement of the ring 34 varies the geometry of the turbine nozzle by variably restricting the nozzle passage but without variation of the vane geometry.

With reference now particularly to FIGS. 1 and 2, an impingement plate 80 having a plurality of holes 82 formed through it is attached across the rear face 77 of the ring 34. Relatively cool air, preferably bled from the compressor outlet, is communicated to the the impingement plate 80 so that this air flow flows through the holes 82 in the impingement plate 80 and against the ring 34 to cool the ring 34. The impingement plate 80 thus minimizes the thermal expansion and thermal distortion of the ring 34.

With reference now particularly to FIG. 1, in the preferred form of the invention, an annular flexible wall 90 is secured along its radially inner edge 92 to the outer radial edge of the ring 34 so that the wall 90 is flush with the front face 36 of the ring 34. The outer radial edge 94 of the flexible wall 90 in turn is attached to the combustion chamber housing so that the flexible wall 90 defines a portion of the outlet passageway from the combustion chamber and to the nozzle passageway 24.

The inner edge of the flexible wall 90 thus follows the position of the ring 34 to achieve an aerodynamically smooth and nonturbulent gas flow from the combustion chamber 14 and through the turbine nozzle.

From the foregoing, it can be seen that the present invention provides a novel construction for varying the aerodynamic geometry of the nozzle passageway in a turbine engine without varying the pitch or angle of the turbine vanes. Moreover, the device of the present invention is compact in construction and virtually fail safe in operation.

A still further advantage of the present invention is that an aerodynamically smooth and nonturbulent passageway is formed between the combustion chamber and through the turbine nozzle due to the attachment of the flexible wall to the ring 34.

Furthermore, the impingement plate maintains the ring 34 at a relatively cool temperature thus minimizing the thermal distortion of the ring 34. Consequently, any distortion of the nozzle geometry from thermal distortion is greatly minimized. Likewise, due to the minimization of thermal distortion of the ring 34, leakage losses from the turbine nozzle are also either greatly minimized or all together eliminated.

Having described our invention, however, many modifications thereto will become apparent to those skilled in the art to which it pertains without deviation from the spirit of the invention as defined by the scope of the appended claims.

We claim:

1. A turbine nozzle for a turbine engine comprising:

a support housing, a combustion chamber contained within the support housing and having an exhaust outlet, said support housing having a pair of spaced walls which form an annular nozzle passageway having its outer end open to said exhaust outlet, said nozzle passageway having an annular opening formed along one nozzle wall, an annular ring slidably mounted in said opening and having an axial end exposed to said nozzle passageway, means for moving said ring transversely across said passageway between a retracted position and an extended position in which said ring protrudes into and restricts said nozzle passageway, and a plurality of circumferentially spaced vanes secured to the other nozzle wall and protruding into said nozzle passageway and wherein said ring includes a plurality of slots which register with and slidably receive said vanes.

2. The invention as defined in claim 1 wherein said vanes extend entirely transversely across said nozzle passageway and into said slots when said ring is in its retracted position.

3. The invention as defined in claim 1 wherein said moving means further comprises at least one actuating rod rotatably mounted to the support housing, an actuating member having one end threadably secured to one end of the actuating rod and its other end secured to said ring, and motor means for rotatably driving said actuating rod.

4. The invention as defined in claim 3 and further comprising a plurality of actuating rods rotatably mounted in said housing, said rods being parallel to and circumferentially spaced from each other, each rod being connected to said ring by one actuating member and wherein said motor means rotatably drives said rods in unison with each other.

5. The invention as defined in claim 1 and further comprising an annular impingement plate having a plurality of openings formed through it, said impingement plate being secured to the other axial end of the ring, and means for communicating a cooling fluid to the impingement plate.

6. The invention as defined in claim 5 wherein said cooling fluid is compressed air.

7. The invention as defined in claim 1 and further comprising an annular flexible wall attached along its inner radial edge to the outer radial edge of said ring so that said flexible wall is flush with said axial end of the ring, and the outer radial edge of the flexible wall being attached to the support housing so that said flexible wall forms a portion of the passageway for the exhaust outlet from the combustion chamber.

8. A turbine nozzle for a turbine engine comprising:

a support housing, a combustion chamber contained within the support housing end having an exhaust outlet, said support housing having a pair of spaced walls which form an annular nozzle passageway having its outer and open to said exhaust outlet, said nozzle passageway having an annular opening formed along one nozzle wall, an annular ring slidably mounted in said opening and having an axial end exposed to said nozzle passageway, means for moving said ring transversely across said passageway between a retracted position and an extended position in which said ring protrudes into and restricts said nozzle passageway, an annular impingement plate having a plurality of openings formed through it, said impingement plate being secured to the other axial end of the ring, and means for communicating a cooling fluid to the impingement plate.

9. The invention as defined in claim 8 wherein said cooling fluid is compressed air.

10. A turbine nozzle for a turbine engine comprising:

a support housing, a combustion chamber contained within the support housing and having an exhaust outlet, said support housing having a pair of spaced walls which form an annular nozzle passageway having its outer end open to said exhaust outlet, said nozzle passageway having an annular opening formed along one nozzle wall, an annular ring slidably mounted in said opening and having an axial end exposed to said nozzle passageway, means for moving said ring transversely across said passageway between a retracted position and an extended position in which said ring protrudes into and restricts said nozzle passageway, an annular flexible wall attached along its inner radial edge to the outer radial edge of said ring so that said flexible wall is flush with said axial end of the ring, and the outer radial edge of the flexible wall being attached to the support housing so that said flexible wall forms a portion of the passageway for the exhaust outlet from the combustion chamber.

* * * * *

UNITED STATES PATENT AND TRADEMARK OFFICE

CERTIFICATE OF CORRECTION

PATENT NO. : 4,552,308

DATED : November 12, 1985

INVENTOR(S) : Casimir Rogo and Herman N. Lenz

It is certified that error appears in the above-identified patent and that said Letters Patent are hereby corrected as shown below:

Column 6, line 2, claim 8, delete "end" and insert --and--.

Column 6, line 5, claim 8, delete "and" and insert --end--.

Signed and Sealed this

Eleventh Day of November, 1986

*Attest:*

DONALD J. QUIGG

*Attesting Officer* *Commissioner of Patents and Trademarks*